US010850149B1

(12) United States Patent
Baldwin et al.

(10) Patent No.: US 10,850,149 B1
(45) Date of Patent: Dec. 1, 2020

(54) WORKOUT APPARATUS TO FACILITATE THE PERFORMANCE OF ISOMETRIC AND DYNAMIC EXERCISES

(71) Applicants: Ryan Carl Baldwin, Pflugerville, TX (US); James Parker, Austin, TX (US)

(72) Inventors: Ryan Carl Baldwin, Pflugerville, TX (US); James Parker, Austin, TX (US)

( * ) Notice: Subject to any disclaimer, the term of this patent is extended or adjusted under 35 U.S.C. 154(b) by 49 days.

(21) Appl. No.: 16/297,195

(22) Filed: Mar. 8, 2019

Related U.S. Application Data

(60) Provisional application No. 62/641,608, filed on Mar. 12, 2018.

(51) Int. Cl.
*A63B 21/002* (2006.01)
*A63B 21/00* (2006.01)
*A63B 23/16* (2006.01)

(52) U.S. Cl.
CPC ..... *A63B 21/0023* (2013.01); *A63B 21/154* (2013.01); *A63B 21/4035* (2015.10); *A63B 23/16* (2013.01)

(58) Field of Classification Search
CPC ..... A63B 21/4049; A63B 21/157; A63B 21/0023; A63B 21/154; A63B 21/4035; A63B 22/14; A63B 22/18; A63B 22/185
See application file for complete search history.

(56) References Cited

U.S. PATENT DOCUMENTS 3,512,774 A * 5/1970 Honer ..... A63B 22/14 482/147
4,195,834 A 4/1980 Lambert, Jr.
4,569,519 A 2/1986 Mattox
4,757,992 A 7/1988 Heitsch
D302,713 S 8/1989 Brentham
D321,387 S 11/1991 Jones
5,180,354 A 1/1993 Jones
5,211,616 A * 5/1993 Riley, Jr. ..... A63B 21/072 482/106
5,256,125 A 10/1993 Jones
5,350,345 A 9/1994 Frey
5,803,882 A 9/1998 Habing
5,897,467 A 4/1999 Habing
5,931,767 A 8/1999 Morales
2017/0304669 A1* 10/2017 LaCaze ..... A63B 21/045
2018/0117384 A1* 5/2018 Endelman ..... A63B 71/0054
2018/0140893 A1* 5/2018 Artioli ..... A63B 21/4049
2018/0243605 A1* 8/2018 Light ..... A63B 21/072
2019/0126092 A1* 5/2019 Miller ..... A63B 24/0087

* cited by examiner

*Primary Examiner* — Jennifer Robertson
*Assistant Examiner* — Catrina A Letterman
(74) *Attorney, Agent, or Firm* — Plager Schack LLP

(57) ABSTRACT

A workout apparatus is designed to connect to an equipment member and engage with hands of the user to facilitate the performance of isometric and dynamic exercises. The workout apparatus includes a bearing having an inner race and an outer race operably connected together and able to permit rotational movement of the inner race, a pair of grip members coupled to opposing sides of the inner race of the bearing, and a bracket coupled to the outer race of the bearing. The bracket allows attachment of the equipment member thereto. The pair of grip members is designed to engage with the hands of the user to facilitate the performance of an isometric exercise. Rotational movement of the pair of grip members and movement of the workout apparatus as permitted by the equipment member facilitate the performance of a dynamic exercise.

9 Claims, 5 Drawing Sheets

WORKOUT APPARATUS TO FACILITATE THE PERFORMANCE OF ISOMETRIC AND DYNAMIC EXERCISES

RELATED APPLICATION

The application claims priority to provisional patent application U.S. Ser. No. 62/641,608 filed on Mar. 12, 2018, the entire contents of which is herein incorporated by reference.

BACKGROUND

The embodiments herein relate generally to exercise apparatuses. More specifically, embodiments of the invention are directed to an exercise apparatus that helps a user to perform both isometric and dynamic movements.

The benefits of isometric movements and dynamic movements performed separately are well documented to help individuals to meet their fitness goals. However, exercise routines that combine both types of movements enhance muscle activation, workout intensity, and workout efficiency. Currently, there is not an exercise apparatus that allows the user to perform both isometric and dynamic movements. Isometric exercises such as planks are frequently performed without the use of equipment. Dynamic exercises are often performed using weighted dumbbells or equipment such as cable machines and the like.

A wide variety of devices used to facilitate dynamic movements including linear mechanisms exists as disclosed in U.S. Pat. Nos. 4,195,834, D302,713 and 5,931,767. Other devices that facilitate rotational dynamic movements exist as disclosed in U.S. Pat. Nos. 4,569,519, 4,757,992, D321,387, 5,180,354 and 5,803,882. Other devices that facilitate dynamic movements targeting bicep muscles in flexion or tricep muscles in extension exist as disclosed in U.S. Pat. Nos. 5,256,125, 5,897,467 and 5,350,345.

However, these devices are limited because they are bulky, difficult to operate, and/or do not allow a user to perform both isometric and dynamic exercises at the same time. Further, these devices are not designed for use in areas of limited space or when individuals are on travel.

As such, there is a need in the industry for a portable workout apparatus capable for use with other equipment that addresses the limitations of the prior art, which permits a user to perform both isometric and dynamic exercises at the same time. There is a further need for the portable workout apparatus to allow a user to perform the isometric and dynamic exercises in areas of limited space such as a room in a hotel, office or home.

SUMMARY

In certain embodiments of the invention, a workout apparatus for use by a user to perform a series of isometric and dynamic exercises simultaneously is provided. The workout apparatus is configured to connect to an equipment member and engage with hands of the user to facilitate performance of the isometric and dynamic exercises. The workout apparatus comprises a bearing comprising an inner race and an outer race operably connected together and configured to permit rotational movement of the inner race while the outer race remains stationary, a pair of grip members coupled to opposing sides of the inner race of the bearing and configured to rotate during rotational movement of the inner race, and a bracket coupled to the outer race of the bearing, the bracket configured to permit attachment of the equipment member thereto, wherein the pair of grip members is configured to engage with the hands of the user to facilitate performance of an isometric exercise, wherein rotational movement of the pair of grip members and movement of the workout apparatus as permitted by the equipment member facilitate performance of a dynamic exercise.

In certain embodiments of the invention, a workout method for performing isometric and dynamic exercises comprises providing a workout apparatus, attaching an equipment member to the bracket of the workout apparatus, engaging with the pair of grip members of the workout apparatus to perform any number of the isometric and dynamic exercises, and maneuvering the workout apparatus as permitted by the equipment member to perform any number of dynamic exercises.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
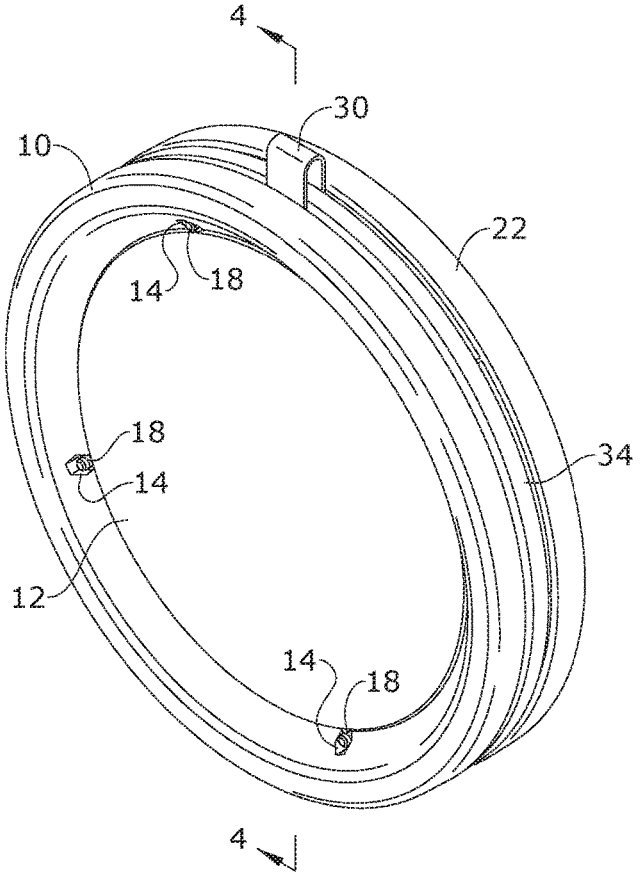
FIG. 1 depicts a top front perspective view of certain embodiments of the workout apparatus.

In certain embodiments of the invention as depicted in FIGS. 1-2 and 8-10, a workout apparatus is configured for use with an equipment member such as cable machine 44 or resistance band 48 to allow user 52 to perform a series of isometric and dynamic exercises. The workout apparatus permits user 52 to perform the isometric and dynamic exercises independently or simultaneously. It shall be appreciated that the workout apparatus may be beneficial or capable of use with other equipment members known in the field.

In certain embodiments as depicted in FIGS. 1-7, the workout apparatus generally comprises first rotating plate 10, first grip pad 12, second rotating plate 22, second grip pad 24, hanger bracket 30, and a bearing comprising outer bearing race 34, inner bearing race 36 and spherical bearing balls 38.

It shall be appreciated that first grip pad 12 and second grip pad 24 are identical and located on opposing sides of the bearing. Similarly, first rotating plate 10 and second rotating plate 22 are identical and located on opposing sides of the bearing. Certain structural features for a component may be highlighted in the following disclosure for simplicity. However, it shall be appreciated that the described structural features are also present in the other corresponding component of the same likeness.

In certain embodiments as depicted in FIGS. 3-6, the bearing comprises outer bearing race 34 operably connected to inner bearing race 36 by a plurality of spherical bearing balls 38. Spherical bearing balls 38 contact both outer and inner bearing races 34, 36 and permit inner bearing race 36 to rotate while outer bearing race 34 remains stationary. In a preferred embodiment, outer bearing race 34, inner bearing race 36 and spherical bearing balls 38 are made from steel or other material of comparable strength.

Hanger bracket 30 is coupled to outer bearing race 34 and serves as an attachment point to connect the workout apparatus to an equipment member such as cable machine 44 or resistance band 48. In one embodiment, hanger bracket 30 is preferably made from steel. However, other high-strength materials known in the field can be used instead. In one embodiment, hanger bracket 30 comprises a U-shaped member coupled to outer bearing race 34 by a set of mechanical fasteners such as screws 32. In one embodiment, screws 32 extend through bracket holes 60 in hanger bracket 30 and outer bearing race holes 62 in outer bearing race 34.

Although the figures illustrate the use of four screws 32, it shall be appreciated that any alternative number of screws can be used to extend through any corresponding number of holes in hanger bracket 30 and outer bearing race 34 to secure the components together. In an alternative embodiment, other fasteners can be used to secure hanger bracket 30 to outer bearing race 34.

In certain embodiments as depicted in FIGS. 3-7, first rotating plate 10 and second rotating plate 22 are coupled to opposing sides of the bearing using a set of mechanical fasteners. In one embodiment, the set of mechanical fasteners comprises bolts 18 and nuts 20. First and second rotating plates 10, 22 are preferably made from Acrylonitrile Butadiene Styrene (ABS) plastic. However, other materials including, but not limited to, other plastics, metals, wood and rubber can be used instead.

Figure 3:
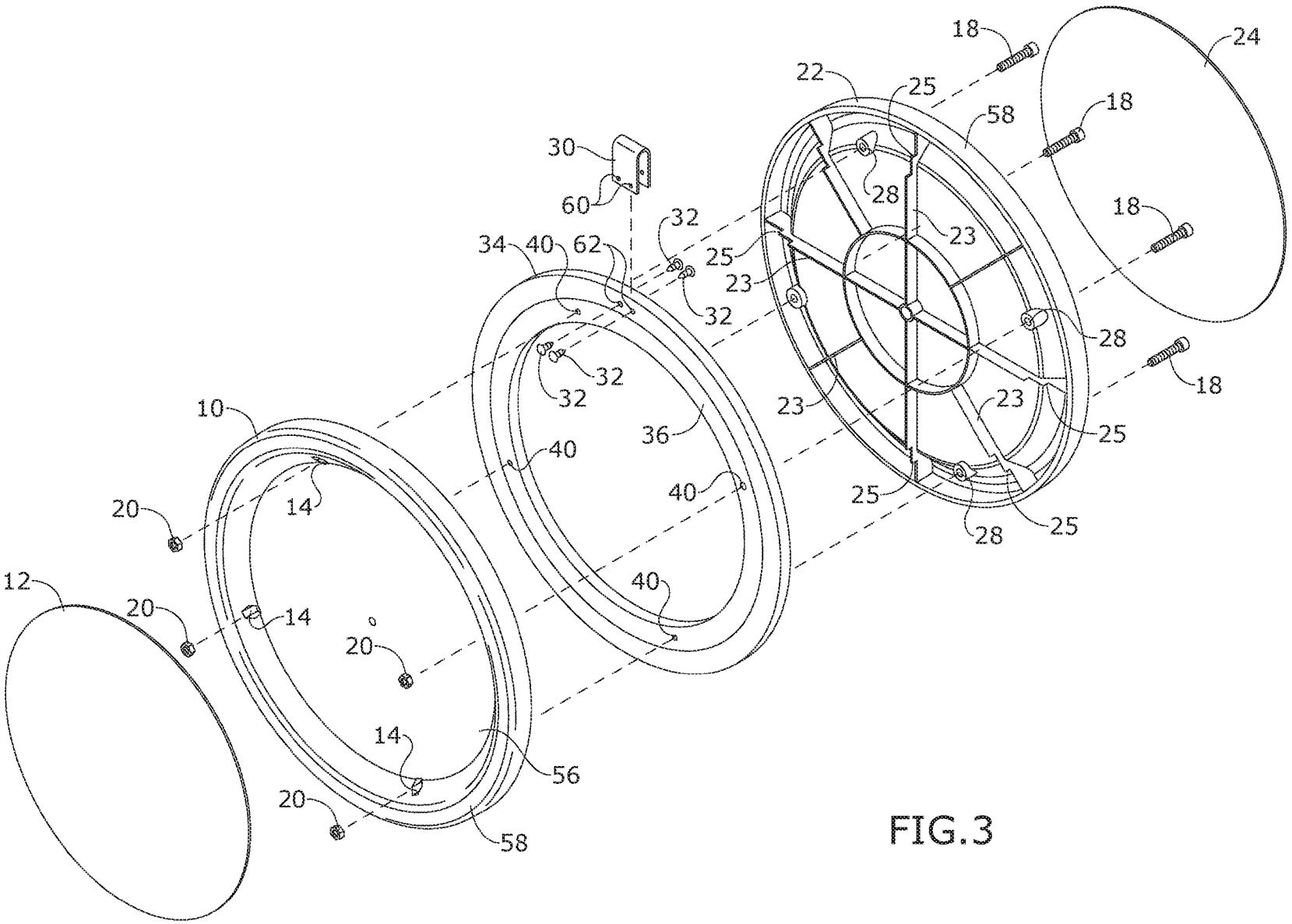
FIG. 3 depicts an exploded view of certain embodiments of the workout apparatus.
Figure 4:
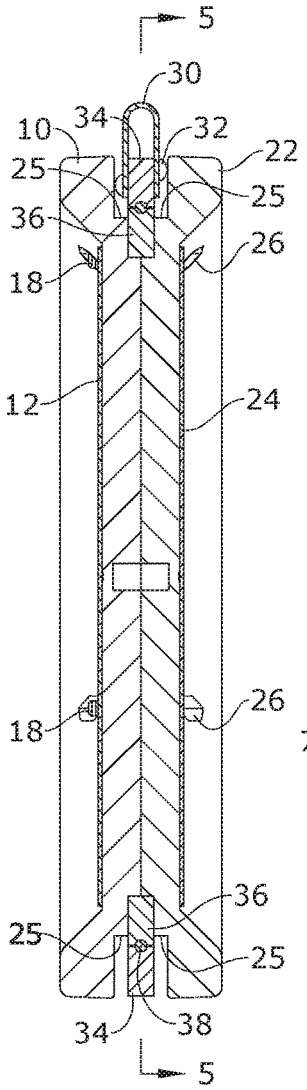
FIG. 4 depicts a section view of certain embodiments of the workout apparatus taken along line 4-4 in FIG. 1.
Figure 5:
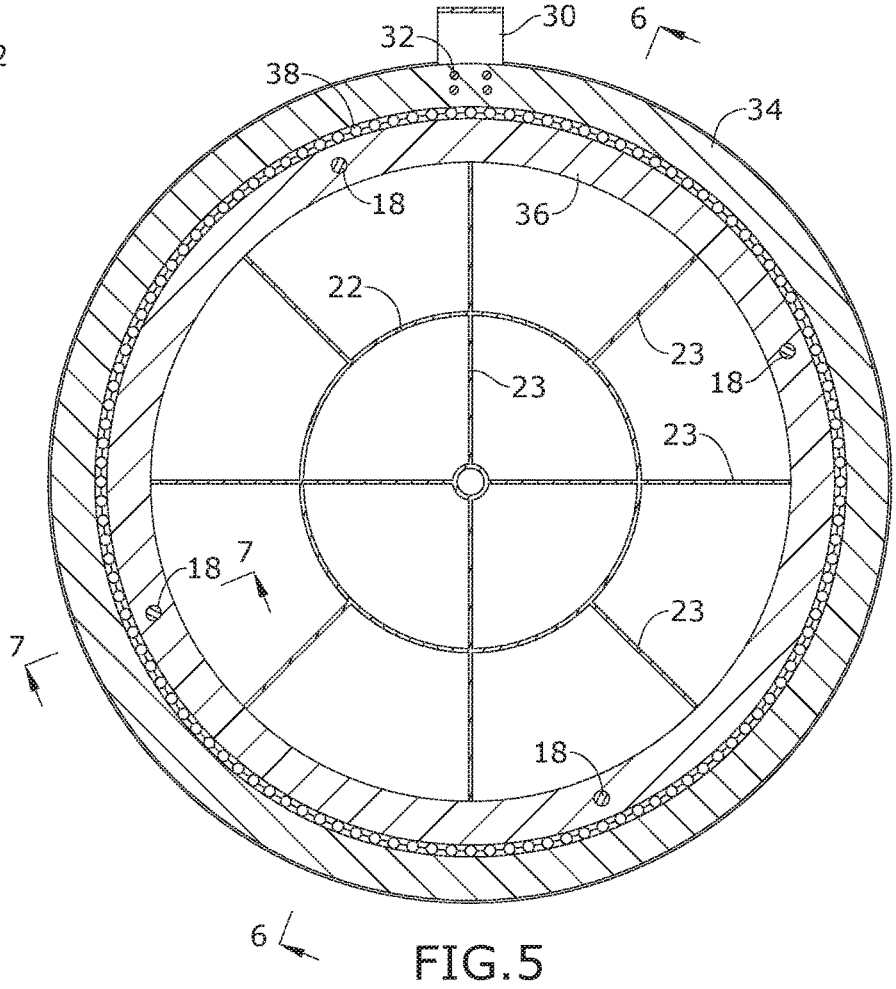
FIG. 5 depicts a section view of certain embodiments of the workout apparatus taken along line 5-5 in FIG. 4.
Figure 6:
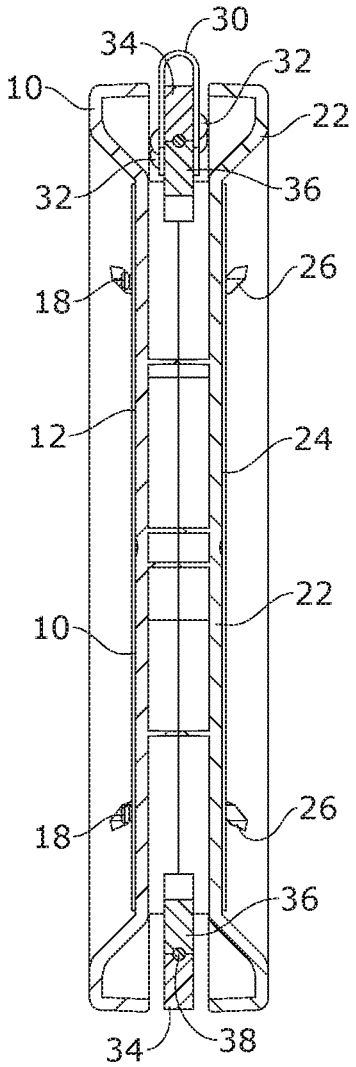
FIG. 6 depicts a section view of certain embodiments of the workout apparatus taken along line 6-6 in FIG. 5.
Figure 7:
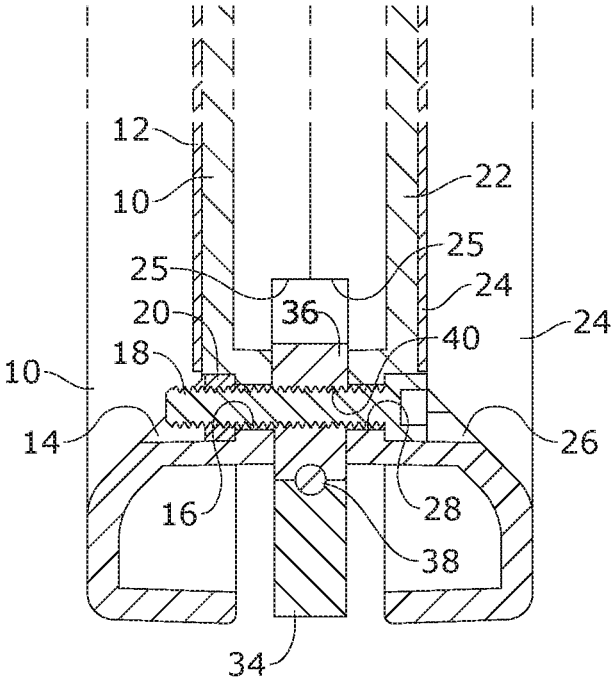
FIG. 7 depicts a section view of certain embodiments of the workout apparatus taken along line 7-7 in FIG. 5.

Each rotating plate in first and second rotating plates 10, 22 comprises central plate 56 continuously connected to outer lip 58. As depicted in FIGS. 3 and 7, outer lip 58 of first rotating plate 10 comprises a plurality of first plate hex slots 14 continuously connected to first plate fastener holes 16. Similarly, outer lip 58 of second rotating plate 22 comprises a plurality of second plate hex slots 26 continuously connected to second plate fastener holes 28. In the secured configuration, bolts 18 extend through second plate hex slots 26 and second plate fastener holes 28 in second rotating plate 22, holes 40 in inner bearing race 36, and first plate hex slots 14 and first plate fastener holes 16 in first rotating plate 10. Nuts 20 engage with threaded portions of bolts 18 to secure first and second rotating plates 10, 22 to inner bearing race 36 of the bearing. In this position, nuts 20 are positioned within first plate hex slots 14 of first rotating plate 10. As depicted in FIG. 4, first and second rotating plates 10, 22 are directly in contact with each other in the assembled configuration.

In one embodiment, each rotating plate in first and second rotating plates 10, 22 comprises a front surface that receives first grip pad 12 or second grip pad 24, and a rear surface having a plurality of ridges 23. As depicted in FIG. 3, ridges 23 extend along the rear surface of each rotating plate 10, 22. In one embodiment, a portion of ridges 23 extends radially along the rear surface of the rotating plate. In one embodiment, each ridge 23 that extends to the perimeter of first rotating plate 10 or second rotating plate 22 comprises stairway portion 25. Each stairway portion 25 of ridge 23 comprises a first step in contact with inner bearing race 36 and a second step positioned a distance away from outer bearing race 34 as depicted in FIGS. 4 and 7. The second step's position away from outer bearing race 34 allows rotating plates 10, 22 to rotate freely relative to a stationary outer bearing race 34.

In certain embodiments as depicted in FIGS. 3-4 and 6-7, first and second grip pads 12, 24 are coupled to first and second rotating plates 10, 22. More specifically, first grip pad 12 is coupled to central plate 56 of first rotating plate 10. Similarly, second grip pad 24 is coupled to central plate 56 of second rotating plate 22. In one embodiment, first and second grip pads 12, 24 are secured to first and second rotating plates 10, 22 by an adhesive. However, mechanical fasteners or other fasteners can be used instead in alternative embodiments.

In a preferred embodiment, first and second grip pads 12, 24 are made from rubber. However, other materials can be used including, but not limited to, silicon, thermoplastics or other materials suitable to enhance grip and friction between hands 54 of user 52 and the grip pads. First and second grip pads 12, 24 can have variable dimensions, but should be sufficiently large to accommodate different sized hands 54 of user 52.

It shall be appreciated that first and second grip pads 12, 24 may comprise any number and arrangement of protrusions or other textures to enhance grip. In one embodiment, first and second grip pads 12, 24 may comprise any number and pattern of openings configured to receive fingers of user 52. These openings in first and second grip pads 12, 24 enhance finger and grip strength, and help to simulate conditions during rock climbing exercises.

In certain embodiments of the invention, the workout apparatus can have variable dimensions to accommodate user 52 and the equipment member. In one embodiment, the workout apparatus comprises a width of approximately 2" and a diameter of approximately 10".

Figure 2:
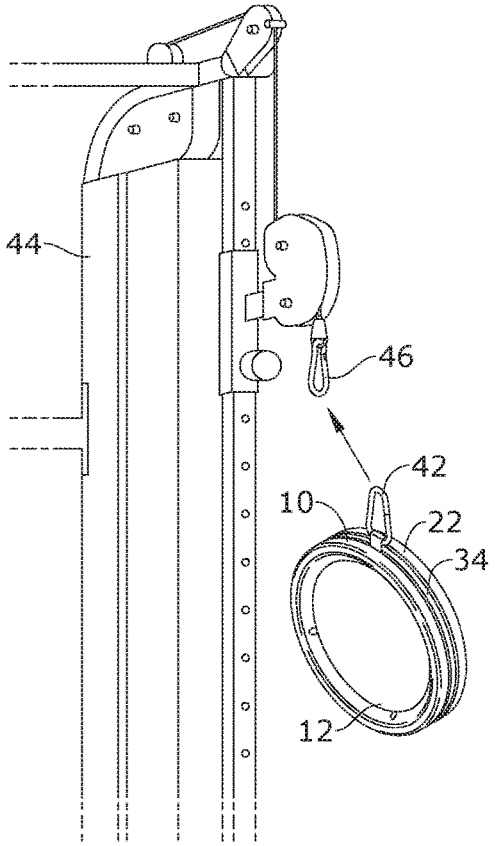
FIG. 2 depicts a top front perspective view of certain embodiments of the workout apparatus illustrating its attachment to cable machine 44.
Figure 8:
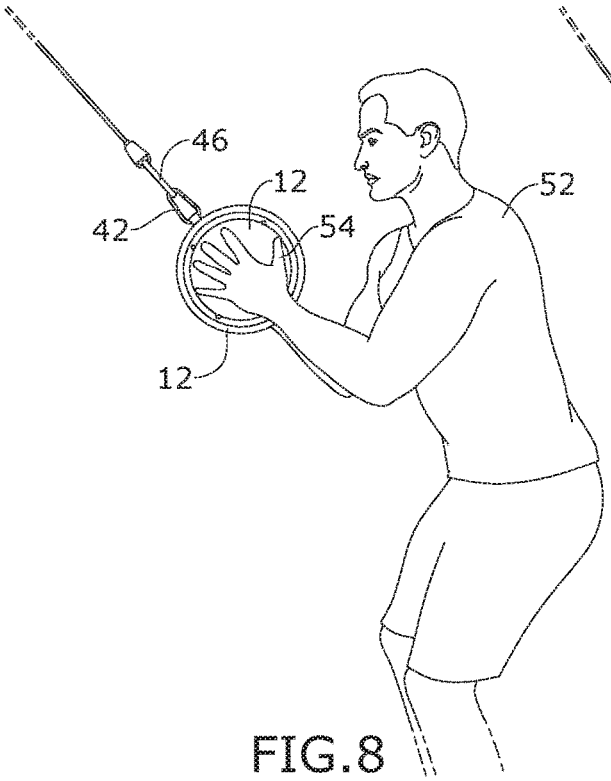
FIG. 8 depicts a side view of certain embodiments of the workout apparatus shown in use.
Figure 9:
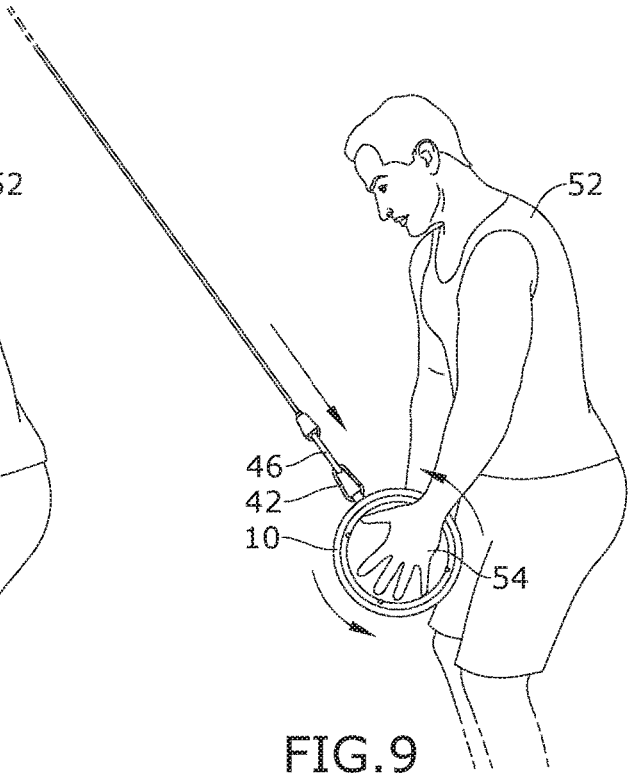
FIG. 9 depicts a side view of certain embodiments of the workout apparatus shown in use.

In operation, the workout apparatus is coupled to an equipment member using hanger bracket 30 and fastening components. In one embodiment as depicted in FIGS. 2 and 8-9, the workout apparatus is coupled to cable machine 44 by using attachment clip 42 such as a carabiner to connect cable machine attachment point 46 to hanger bracket 30. After the workout apparatus is connected to cable machine 44, user 52 places hands 54 on first and second grip pads 12, 24. The force applied on first and second grip pads 12, 24 by hands 54 allows user 52 to perform an isometric exercise.

As depicted in FIGS. 8-9, user 52 can maneuver hands 54 on the workout apparatus to perform a series of dynamic exercises including bicep curls and tricep extensions. Cable machine 44 provides resistance to any motion of the workout apparatus. At the same time, the bearing of the workout apparatus allows hands 54 of user 52 to rotate as first and second rotating plates 10, 22 rotate as illustrated by the arrows in FIG. 9. This rotation of first and second rotating plates 10, 22 increases the range of motion of hands 54 and allows user 52 to perform additional dynamic exercises/movements with the workout apparatus.

Figure 10:
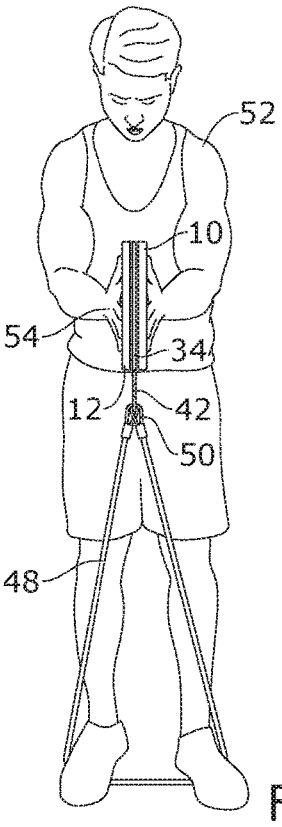
FIG. 10 depicts a front view of certain embodiments of the workout apparatus shown in use.

In an alternative embodiment as depicted in FIG. 10, the workout apparatus is connected to another equipment member such as resistance band 48. In this embodiment, attachment clip 42 such as a carabiner connects band clips 50 of resistance band 48 to hanger bracket 30 of the workout apparatus. User 52 places his/her feet on resistance band 48 and grasps first and second grip pads 12, 24 of the workout apparatus. User 52 maneuvers hands 54 on the workout apparatus to perform any series of isometric and dynamic exercises including, but not limited to, bicep curls, tricep extensions, shoulder raises, and the like.

It shall be appreciated that the components of the workout apparatus described in several embodiments herein may comprise any alternative known materials in the field and be of any color, size and/or dimensions. It shall be appreciated that the components of the workout apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A workout apparatus for use by a user to perform a series of isometric and dynamic exercises simultaneously, the workout apparatus configured to connect to an equipment member and engage with hands of the user to facilitate performance of the isometric and dynamic exercises, the workout apparatus comprising:

a bearing comprising an inner race and an outer race operably connected together and configured to permit rotational movement of the inner race while the outer race remains stationary;

a pair of grip members coupled to opposing sides of the inner race of the bearing and configured to rotate during rotational movement of the inner race;

a bracket coupled to the outer race of the bearing, the bracket configured to permit attachment of the equipment member thereto; and a pair of rotating plates directly coupled to the inner race of the bearing, a first rotating plate in the pair of rotating plates directly coupled to a first grip member in the pair of grip members, a second rotating plate in the pair of rotating plates directly coupled to a second grip member in the pair of grip members;

wherein the pair of grip members is configured to engage with the hands of the user to facilitate performance of an isometric exercise, wherein rotational movement of the pair of grip members and movement of the workout apparatus as permitted by the equipment member facilitate performance of a dynamic exercise.

2. The workout apparatus of claim 1, wherein each of the rotating plates in the pair of rotating plates comprises a front surface in contact with one of the pair of grip members and a rear surface in contact with the other rotating plate in the pair of rotating plates.

3. The workout apparatus of claim 2, wherein the rear surface of each rotating plate in the pair of rotating plates comprises a plurality of ridges extending along the rear surface of the rotating plate, wherein the plurality of ridges comprises a plurality of stairways located proximate a perimeter of the rotating plate, each stairway in the plurality of stairways in contact with the inner race of the bearing.

4. The workout apparatus of claim 3, wherein the bracket comprises a U-shaped member coupled to the outer race of the bearing by a first set of mechanical fasteners.

5. The workout apparatus of claim 4, wherein the bearing comprises a plurality of spherical balls in contact with the inner and outer races.

6. The workout apparatus of claim 5, wherein each rotating plate in the pair of rotating plates comprises an outer lip continuously connected to a central plate, the central plate coupled to one of the pair of grip members.

7. The workout apparatus of claim 6, further comprising a second set of mechanical fasteners connecting the pair of rotating plates to the inner race of the bearing.

8. A workout method for performing isometric and dynamic exercises, the method comprising:

providing a workout apparatus, the workout apparatus comprising:

a bearing comprising an inner race and an outer race operably connected together and configured to permit rotational movement of the inner race while the outer race remains stationary;

a pair of grip members coupled to opposing sides of the inner race of the bearing and configured to rotate during rotational movement of the inner race;

a bracket coupled to the outer race of the bearing; and a pair of rotating plates directly coupled to the inner race of the bearing, a first rotating plate in the pair of rotating plates directly coupled to a first grip member in the pair of grip members, a second rotating plate in the pair of rotating plates directly coupled to a second grip member in the pair of grip members;

attaching an equipment member to the bracket of the workout apparatus; and engaging with the pair of grip members of the workout apparatus to perform any number of the isometric and dynamic exercises.

9. The workout method of claim 8, further comprising maneuvering the workout apparatus as permitted by the equipment member to perform any number of dynamic exercises.

* * * * *